US006309441B1

(12) United States Patent
Benz et al.

(10) Patent No.: US 6,309,441 B1
(45) Date of Patent: Oct. 30, 2001

(54) REDUCTION-MELTING PROCESS TO FORM RARE EARTH-TRANSITION METAL ALLOYS AND THE ALLOYS

(75) Inventors: Mark Gilbert Benz, Burnt Hills; Robert John Zabala, Schenectady; Vladimir Nikolayevich Radchenko, New York, all of NY (US); Anatoly Danilovich Riabtsev, Makeevka; Oleg Vladimirovich Tarlov, Donetsk, both of (UA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/284,688

(22) PCT Filed: Oct. 8, 1997

(86) PCT No.: PCT/US97/18367

§ 371 Date: Apr. 16, 1999

§ 102(e) Date: Apr. 16, 1999

(87) PCT Pub. No.: WO98/15667

PCT Pub. Date: Apr. 16, 1998

Related U.S. Application Data

(60) Provisional application No. 60/027,978, filed on Oct. 8, 1996.

(51) Int. Cl.[7] ..... C22B 59/00; C22C 28/00

(52) U.S. Cl. ..... 75/10.46; 75/610; 420/83; 420/581; 420/590

(58) Field of Search ..... 75/10.46, 610; 420/581, 590, 83

(56) References Cited

U.S. PATENT DOCUMENTS 4,578,242 * 3/1986 Sharma ..... 420/590
5,071,472 12/1991 Traut et al. .
5,087,291 * 2/1992 Schmidt et al. ..... 75/581
5,174,811 * 12/1992 Schmidt et al. ..... 75/581
5,314,526 * 5/1994 Sharma ..... 75/610
5,332,197 7/1994 Benz et al. .
5,472,525 * 12/1995 Tokunaga et al. ..... 148/302

OTHER PUBLICATIONS

Ellis et al, "Methods and Opportunities in the Recycling of Rare Earth Based Materials", Metals and Materials Waste Reduction, Recovery and Remediation, 1994, pp. 199–206.*

Abstract—Ellis, T.W. et al., Methods and Opportunities in the Recycling of Rare Earth Based Materials, Minerals, Metals and Meterials Scoeity/AIME, USA, Oct. 1994, pp. 199–206, 12 Ref. Accession No.: 19(95):3—2–00.

Japanese Abstract 59023811, Jul. 1984 Naoyuki, Yamauchi (inventor).

International Search Report PCT/US97/18367 Feb. 12, 1998.

* cited by examiner

*Primary Examiner*—Roy King
*Assistant Examiner*—Tima McGuthry-Banks
(74) *Attorney, Agent, or Firm*—Noreen C. Johnson; Douglas E. Stoner

(57) ABSTRACT

Rare earth alloy compositions, such as the neodymium iron boron (NdFeB) alloy are made by a Reduction-Melting process. The Reduction-Melting process comprises preparing a primary electrode containing at least one compound or metal to be reduced to form a refined metal or metal alloy ingot; placing the electrode in an electroslag refining furnace; passing a current through the electrode into a molten flux or slag to melt the electrode; reducing the metal or compound in the slag while forming an oxide by-product; collecting melted metal or metal alloy droplets falling through the slag; forming an ingot of the metal or metal alloy from the melted droplets; and collecting the solid oxide byproducts in the slag.

16 Claims, No Drawings

REDUCTION-MELTING PROCESS TO FORM RARE EARTH-TRANSITION METAL ALLOYS AND THE ALLOYS

This application is a national stage of PCT, International Application Ser. No. PCT/US97/18367, which in turn claims the priority of Provisional Application Ser. No. 60/027,978, filed Oct. 8, 1996.

FIELD OF THE INVENTION

The present invention relates generally to a process for making rare earth-transition metal alloys. In particular, the invention relates to a process using electroslag refining to melt an electrode and reduce metal oxides in a calcium-containing slag to form rare earth-transition metal alloys used in permanent magnets.

BACKGROUND OF THE INVENTION

Medical imaging systems presently are committed to using rare earth permanent magnets made from alloys of neodymium iron boron (Nd-Fe-B), such as $Fe_{14}Nd_2B$. The main polarizing field in this system is provided by two very large neodymium iron boron (NdFeB) permanent magnets, with an iron yoke used for the return path.

The standard techniques for preparation of the highest performance NdFeB permanent magnets build on the process developed for samarium cobalt magnets, such as $SmCo_5$ magnets. The alloy is prepared, crushed to a fine powder, oriented in a magnetic field, pressed, sintered, annealed, machined, magnetized, and used. This is done with powders and may require no melting. While there are many steps in this process, the overall cost is dominated by the first step, preparation of the alloy. For $SmCo_5$ magnets, the Reduction-Diffusion (R-D) process has become the most economical approach used for preparation of the alloy. In this process cobalt powder, calcium granules, and rare earth oxide powder are blended together and reacted under hydrogen at 1150° C. The calcium reduces the samarium oxide, and the samarium metal diffuses into the cobalt. After cooling, the excess calcium and calcium oxide are removed from the reacted product by hydrating with wet nitrogen, followed by washing with water and dilute acid. The principal cost advantage for this approach is realized by starting samarium as an oxide rather than as a pure metal.

Variations of the Reduction-Diffusion process have been applied to of neodymium iron boron (NdFeB) permanent magnets. It was found that alloy composition control and the leaching step are more difficult and expensive with of neodymium iron boron (NdFeB) than samarium cobalt ($SmCo_5$) magnets, limiting somewhat the commercial usefulness of these variations for of neodymium iron boron (NdFeB). As a result, separate reduction and melting steps are primarily used for preparation of the of neodymium iron boron (NdFeB) alloy commercially. This approach requires very expensive high performance vacuum melting furnaces. Thus, a need is created for a lower cost method to make the of neodymium iron boron (NdFeB) alloy needed for the permanent magnet.

SUMMARY OF THE INVENTION

To satisfy this need, a method has been invented to make rare earth alloy compositions, such as the neodymium iron boron (NdFeB) alloy by a Reduction-Melting process. The Reduction-Melting process of this invention comprises the steps of: preparing a primary electrode containing at least one compound or metal to be reduced to form a refined metal or metal alloy ingot; placing said electrode in an electroslag refining furnace; passing a current through said electrode into a molten flux or slag to melt said electrode; reducing the metal or compound in the slag while forming an oxide by-product; collecting melted metal or metal alloy droplets falling through the slag; forming an ingot of said metal or metal alloy from said melted metal metal alloy droplets in a cooled crucible; and solidifying the slag containing oxide byproducts.

The inventive process is calciothermic and uses a reducing agent, such as pure calcium, magnesium, aluminum or a reducing compound such as, but not limited to, calcium hydride or calcium carbide. The reducing agent may be present in the electrode composition and may be further fed into the crucible of slag during the electroslag refining operation. The slag composition is any suitable material that becomes molten when heated and is capable of refining and reducing the electrode material. Halide compositions are often used as slag materials in electroslag refining. For instance, a slag may comprise a metal halide, such as calcium halide, a reducing agent, such as calcium, and additional metals and compounds that will form the refined metal or metal alloy ingot.

Melting of the electrode is accomplished by electroslag refining. The method further comprises the melting of electrodes in neutral or reducing atmospheres. The reduction of alloying elements or compounds that are contained in the electrode or that are added to the slag, takes place in the molten slag by refining the melted electrode droplets. Generally, the electrodes contain compounds of the alloying elements that are desired in the final refined ingot. For example, if neodymium, lanthanum, or zirconium are the alloying elements of interest, they may be present in the electrode as oxides, fluourides, or chlorides. They usually are present in quantities of about 50% or less in the electrode. Metal compounds, containing the desired element or elements in the refined ingot, can also be fed directly into the slag during the electroslag refining operation.

The process of this invention could be used for all rare earth-transition metal alloys of interest, such as alloys of neodymium iron boron (NdFeB), samarium cobalt such as $Sm_2Co_{17}$ or $SmCo_5$, lanthanum nitride, such as $LaNi_5$, for hydrogen storage media, and for other elements which need to be reduced, such as chromium, vanadium, cobalt, boron, manganese, scandium, and beryllium.

Advantages of the Reduction-Melting process for rare earth-transition metal alloys include a cost reduction in traditional manufacturing of neodymium iron boron NdFeB permanent magnets by using neodymium as an oxide starting material rather than a pure metal. Also, the electroslag refining furnace is less expensive than high performance vacuum melting furnaces. A further advantage of the inventive process is the easy separation of oxide byproducts, such as calcium oxide, and the metal alloy. Also, the leaching step is eliminated when recovering the alloy.

DESCRIPTION OF THE INVENTION

The Reduction-Melting (R-M) process can be used for all rare earth-transition metal alloys of interest and other metals and metal alloys that need to be reduced. To demonstrate the invention, the application of the Reduction-Melting process for preparing the neodymium iron boron (NdFeB) alloy will be considered. This invention however, is not limited to only the preparation of neodymium iron boron alloys.

Electroslag refining can be described as a process where the electrode material is melted by passing a current through it into a molten flux or slag, which is resistively heated and which, in turn, melts the electrode. Molten metal forms on the end of the electrode and falls as droplets through the flux, forming an ingot in a cooled crucible. The process continues until the electrode is consumed and the ingot is formed.

The preparation of an electrode containing stoichiometric amounts of neodymium oxide, boron oxide, iron, and calcium or calcium hydride is the first step. The electrode is formed by methods known to those skilled in the art. After the electrode is made, the electrode is placed in an electroslag refining furnace and subsequently melted in an electroslag refining system suitable for use with calcium and calcium fluoride or calcium chloride active slags. The furnace atmosphere is neutral, inert, or a reducing atmosphere. A current is passed through the electrode into the molten slag and the electrode end surface that touches the slag begins to melt. Molten metal droplets from the electrode are reduced by calciothermic reduction in the slag so that the neodymium iron boron (NdFeB) alloy is refined in the slag as metal alloy droplets and collected and formed into a refined metal alloy ingot.

The neodymium oxide in the electrode is reduced in the slag by the calcium. In turn, calcium oxide is formed in the slag. Other elements are reduced if needed to form the refined metal alloy ingot. When Reduction-Melting is complete, the solidified slag, containing the calcium oxide byproduct, is easily physically separated from the refined neodymium iron boron (NdFeB) ingot.

Variations on this approach are many and also are considered part of the invention. For instance, an iron electrode may be used while neodymium-oxide and boron oxide are added continuously in a stoichiometric amount to the slag. Again, the neodymium oxide is reduced in the slag, the metal alloy droplets form, and fall through the slag, to be collected into a refined metal alloy ingot.

In this invention, the halide flux, also referred to as slag, is preferably calcium fluoride ($CaF_2$). The halide flux may have suitable additions, such as dissolved metals and oxides. In a preferred embodiment calcium metal is present in the flux with calcium fluoride. Further, the slag is not limited to calcium/calcium fluoride. Halides of calcium, such as calcium chloride, may also be used. Other metals and oxides may be present such as neodymium oxide and boron oxide when the metal alloy being prepared is neodymium iron boron (NdFeB). The slag serves to reduce the metal oxide starting material to the pure metal which then becomes part of the alloy, if other metal are present. For instance, neodymium oxide is reduced in -the calcium slag and neodymium metal is then available to form the neodymium iron boron (NdFeB) alloy. The other constituents needed to form the desired alloy are present in the electrode or slag in stoichiometric quantities. To further demonstrate, to produce $Fe_{14}Nd_2B$ by the calcium reduction of $Nd_2O_3$ and $B_2O_3$ could be represented by the equation:

$$2^{Nd}{}_2O_3+B_2O_3+28Fe+9Ca\rightarrow 2Fe_{14}Nd_2B+9CaO.$$

Alternatively, B could be introduced in another form, such as ferroboron.

Example 1

Electrodes containing stoichiometric amounts of compounds to form the desired rare earth-transition metal alloy are prepared in the shape of a cylinder having a diameter about 60 millimeters (mm) and about 250 to about 275 mm long. The electroslag refining system is similar to that used for melting titanium, chromium or copper. The water cooled crucible to produce the metal alloy ingot is about 95 mm inside diameter and about 360 mm long and capable of producing an ingot up to about 200 mm in length. The electrode is placed inside a water cooled chamber mounted above the water cooled crucible. The crucible and chamber are evacuated and then back filled with argon before melting. The system is kept at a positive pressure of argon of 0.15 atmospheres during melting. A small flow of argon occurs to compensate for leakage out of the various seals in the system. The active slag is made up from about 1000 grams of calcium fluoride and about 20 grams of metallic calcium. Calcium vapor rises into the chamber above the crucible and reacts with the small amounts of oxygen and nitrogen in the argon to reduce the partial pressure of oxygen to less than $10^{-20}$ atmospheres and the partial pressure of nitrogen to less than $10^{-15}$ atmospheres. A typical melting run consists of a starting period at low current to melt the slag, followed by a melting period at higher currents to melt the electrode. Melting is carried out at the melting currents of about 4 to 7 kilo amps (KA). A time of about 7 to about 10 minutes is required for completion of melting.

The reaction for the simultaneous reduction of neodymium oxide and formation of iron-neodymium-boron alloy can be written:

$$2Nd2O3+6Ca+28Fe+2B=6CaO+2Fe14Nd2B$$

Although the rare earth element of interest is primarily neodymium, it may also contain substantial amounts of other rare earths (for example: praseodymium, lanthanum, cerium, etc.). Also, rare earth fluorides, oxalates, or carbonates may be substituted for the rare earth oxide. Calcium hydride may be substituted for the calcium. The transition metal of interest is primarily iron, but may also contain substantial amounts of other transition metals.

The ESR electrode is prepared from neodymium oxide, calcium, iron and boron, maintaining the molar ratio of about:

2 moles of Nd2O3

6 moles of Ca 28 moles of Fe 2 moles of B.

The preferred technique for formation of the ESR electrode is to hydropress powders of neodymium oxide, iron, iron-boron alloy, and chips of metallic calcium. A second technique to form an electroslag refined (herein ESR) electrode is to hydropress powders of neodymium oxide, iron, and iron-boron alloy, and then attach rods or bars of metallic calcium just before ESR processing. A third technique to form an ESR electrode is to hydropress powders of neodymium oxide, iron, and iron-boron alloy, and then add metallic calcium to the slag pool during ESR processing.

In all variations: the ESR slag is primarily calcium fluoride. The slag is heated by passing electric current from the electrode, through the slag, and into the iron-neodymium-boron alloy below. The electrode is melted by immersion in the slag. The rare earth oxide is reduced by the calcium. The by-product calcium oxide is dissolved in the slag. The iron-neodymium-boron alloy is formed and collected as a liquid melt underneath the slag, where it slowly solidifies and the ESR processing continues. In one variation, reduction of the rare earth oxide can be assisted by application of polarized direct current in addition to the main ESR alternating current.

Example 2

Added Reducing Agent: The reactions, electrodes and procedures are identical to the Base Case, Example 1, except that the added reducing agent is increased by up to 30 to 50% to more completely reduce the neodymium oxide. For example, an electrode with 30% increase would have the molar ratio of about:

2 moles of Nd2O3

7.8 moles of Ca 28 moles of Fe 2 moles of B.

Example 3

Added Reactant: The reactions, electrodes and procedures are identical to the Base Case, Example 1 and Added Reducing Agent Case, Example 2, except that the added reactants (neodymium oxide and boron) are increased by up to 30 to 50% to increase the levels of neodymium in the iron-neodymium alloy formed.

For example, an electrode with 30% increase would have the molar ratio of about:

2.6 moles of Nd2O3

7.8 to 11.7 moles of Ca 28 moles of Fe 2.6 moles of B.

Example 4

Rare Earth Fluoride Case: The reaction for the simultaneous reduction of neodymium fluoride and formation of iron-neodymium-boron alloy can be written:

2NdF3+3Ca+14Fe+B=3CaF2+Fe14Nd2B.

Although the rare earth element of interest is primarily neodymium, it may also contain substantial amounts of other rare earths (for example: praseodymium, lanthanum, cerium, etc. Calcium hydride may be substituted for the calcium. The transition metal of interest is primarily iron, but may also contain substantial amounts of other transition metals.

The ESR electrode is prepared from neodymium oxide, calcium, iron and boron, maintaining the molar ratio:

2 moles of NdF3

3 moles of Ca 14 moles of Fe 1 mole of B.

The preferred technique for formation of the ESR electrode is to hydropress powders of neodymium fluoride, iron, iron-boron alloy, and chips of metallic calcium. A second technique to form an ESR electrode is to hydropress powders of neodymium fluoride, iron, and iron-boron alloy, and then attach rods or bars of metallic calcium just before ESR processing. A third technique to form an ESR electrode is to hydropress powders of neodymium fluoride, iron, and iron-boron alloy, and then add metallic calcium to the slag pool during ESR processing.

In all variations: the ESR slag is primarily calcium fluoride. The slag is heated by passing electric current from the electrode, through the slag, and into the iron-neodymium-boron alloy below. The electrode is melted by immersion in the slag. The rare earth fluoride is reduced by the calcium. The by-product calcium fluoride is dissolved in the slag. The iron-neodymium-boron alloy is formed and collected as a liquid melt underneath the slag, where it slowly solidifies and the ESR processing continues. In one variation, reduction of the rare earth fluoride can be assisted by application of polarized direct current in addition to the main ESR alternating current.

What is claimed is:

1. A reduction-melting process to form rare earth alloy compositions used in permanent magnets comprising the steps of:

adding to a molten slag halide flux containing a reducing agent at least one rare earth oxide, at least one transition metal compound and a boron containing-compound to be reduced;

placing a non-consumable electrode in contact with the electroslag halide flux;

passing a current through said electrode into the molten flux to reduce the rare earth oxide, the transition metal compound and the boron containing-compound while forming oxide byproducts in the slag;

collecting a rare earth-transition metal-boron reduced compound droplets falling through the slag;

forming a refined ingot of said rare earth-transition metal-boron reduced droplets in a cooled crucible; and solidifying the slag containing oxide byproducts.

2. A process according to claim 1 where the rare earth is selected from the group consisting of neodymium, praseodymium, lanthanum, cerium, terbium, dysprosium, holmium, erbium, europium, samarium, gadolinium, promethium, thulium, ytterbium, lutetium, yttrium and mixtures thereof.

3. A process according to claim 2 where the rare earth comprises a mixture of neodymium, praseodymium, lanthanum and cerium.

4. A process according to claim 1 where the reducing agent is a metal or metal compound.

5. A process according to claim 4 where the reducing agent is selected from the group consisting of calcium, aluminum, manganese, calcium hydride, calcium carbide, and mixtures there.

6. A process according to claim 1 where the flux is a calcium compound flux.

7. A process according to claim 6 where the calcium compound is a halide.

8. A process according to claim 7 where the calcium halide is calcium fluoride.

9. A process according to claim 1 where the flux contains calcium halide and calcium.

10. A process according to claim 1 where the transition metal is selected from the group consisting of iron, cobalt and mixtures thereof.

11. A process according to claim 1 where the refined ingot is further processed to form a permanent magnet.

12. A process to form rare earth-iron-boron ingots for comprising the steps of: preparing a primary electrode containing at least one rare earth oxide, iron, and at least one boron compound to be reduced to form a refined metal alloy ingot; placing said electrode in an electroslag refining furnace; passing a current through said electrode into a molten slag to melt said electrode; reducing the metal or oxide in the slag while forming an oxide by-product; collecting melted metal alloy droplets falling through the slag; forming an ingot of said rare earth-iron-boron metal alloy from said melted metal alloy droplets in a second crucible; and solidifying the slag containing oxide byproducts.

13. The process of claim 12 where the rare earth is selected from the group consisting of neodymium, praseodymium, lanthanum, cerium, and mixtures thereof.

14. A process according to claim 12 where the slag further comprises a reducing agent selected from the group consisting of calcium, aluminum, manganese, calcium hydride, calcium carbide, and mixtures thereof.

15. A process according to claim 12 where the metal alloy is NdFeB.

16. A process according to claim 15 where the NdFeB is further processed to form a permanent magnet for medical imaging systems.

* * * * *